US007770878B2

(12) United States Patent
Hosoi

(10) Patent No.: US 7,770,878 B2
(45) Date of Patent: Aug. 10, 2010

(54) IMAGE FORMING APPARATUS

(75) Inventor: Kenichi Hosoi, Kawaguchi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 58 days.

(21) Appl. No.: 12/327,361

(22) Filed: Dec. 3, 2008

(65) Prior Publication Data

US 2009/0146363 A1 Jun. 11, 2009

(30) Foreign Application Priority Data

Dec. 6, 2007 (JP) ..... 2007-315919

(51) Int. Cl.
*B65H 3/44* (2006.01)

(52) U.S. Cl. ..... 271/9.01; 271/9.05; 271/97; 271/98

(58) Field of Classification Search ..... 271/9.01, 271/9.05, 97, 98
See application file for complete search history.

(56) References Cited

U.S. PATENT DOCUMENTS 7,568,691 B2 * 8/2009 Matsumoto ..... 271/97
2007/0262513 A1 * 11/2007 Fukusaka ..... 271/98
2008/0012202 A1 * 1/2008 Hubl et al. ..... 271/98

FOREIGN PATENT DOCUMENTS

| | | |
|---|---|---|
| JP | 7-101579 | 4/1995 |
| JP | 10-315556 | 12/1998 |
| JP | 2001-80750 | 3/2001 |

* cited by examiner

*Primary Examiner*—David H Bollinger
(74) *Attorney, Agent, or Firm*—Finnegan, Henderson, Farabow, Garrett & Dunner, L.L.P.

(57) ABSTRACT

Disclosed is an image forming apparatus including: a plurality of paper feed trays in which paper sheets are to be stacked; paper feed units each provided to each of the plurality of paper feed trays, the paper feed units sucking or discharging air in accordance with setting values corresponding to types of paper sheet to carry the paper sheets stacked in the respective paper feed trays toward a paper path; a storage unit to store the setting values for the paper feed units according to the types of paper sheet; an input unit to input a change instruction value for changing at least one of the setting values; and a control unit to change the at least one of the setting values stored in the storage unit into the change instruction value and to store the changed at least one of the setting values into the storage unit.

5 Claims, 15 Drawing Sheets

FIG.3

| PROFILE NUMBER | | 01 | 02 | 03 | ··· |
|---|---|---|---|---|---|
| SIZE | | A4 | A3 | A4R | ··· |
| PAPER TYPE | | PLAIN PAPER | PLAIN PAPER | COATED PAPER | ··· |
| PAPER WEIGHT [g/m$^2$] | | 62 - 71 | 210 - 244 | 40 - 49 | ··· |
| COLOR | | WHITE | WHITE | WHITE | ··· |
| TRAY 1 | FLOATING UNIT | 3 | 8 | 2 | ··· |
| | ADHERING UNIT | 5 | 9 | 3 | ··· |
| TRAY 2 | FLOATING UNIT | 3 | 8 | 2 | ··· |
| | ADHERING UNIT | 5 | 9 | 3 | ··· |
| TRAY 3 | FLOATING UNIT | 3 | 8 | 2 | ··· |
| | ADHERING UNIT | 5 | 9 | 3 | ··· |
| TRAY 4 | FLOATING UNIT | 3 | 8 | 2 | ··· |
| | ADHERING UNIT | 5 | 9 | 3 | ··· |

FIG.4

| TRAY NAME | | TRAY 1 | TRAY 2 | TRAY 3 | TRAY 4 |
|---|---|---|---|---|---|
| SIZE | | A4 | A3 | A4 | A4R |
| PAPER TYPE | | PLAIN PAPER | PLAIN PAPER | PLAIN PAPER | COATED PAPER |
| PAPER WEIGHT[g/m$^2$] | | 62 - 71 | 210 - 244 | 62 - 71 | 40 - 49 |
| COLOR | | WHITE | WHITE | WHITE | WHITE |
| REFERENCE PROFILE NUMBER | | 01 | 02 | 01 | 03 |
| TRAY 1 | FLOATING UNIT | 3 | | | |
| | ADHERING UNIT | 5 | | | |
| TRAY 2 | FLOATING UNIT | | 8 | | |
| | ADHERING UNIT | | 9 | | |
| TRAY 3 | FLOATING UNIT | | | 3 | |
| | ADHERING UNIT | | | 5 | |
| TRAY 4 | FLOATING UNIT | | | | 2 |
| | ADHERING UNIT | | | | 3 |

FIG.11

| PROFILE NUMBER | | 01 | 02 | 03 | ··· |
|---|---|---|---|---|---|
| SIZE | | A4 | A3 | A4R | ··· |
| PAPER TYPE | | PLAIN PAPER | PLAIN PAPER | COATED PAPER | ··· |
| PAPER WEIGHT[g/m$^2$] | | 62 - 71 | 210 - 244 | 40 - 49 | ··· |
| COLOR | | WHITE | WHITE | WHITE | ··· |
| TRAY 1 | FLOATING UNIT | 4 | 8 | 2 | ··· |
| | ADHERING UNIT | 7 | 9 | 3 | ··· |
| TRAY 2 | FLOATING UNIT | 4 | 8 | 2 | ··· |
| | ADHERING UNIT | 7 | 9 | 3 | ··· |
| TRAY 3 | FLOATING UNIT | 4 | 8 | 2 | ··· |
| | ADHERING UNIT | 7 | 9 | 3 | ··· |
| TRAY 4 | FLOATING UNIT | 4 | 8 | 2 | ··· |
| | ADHERING UNIT | 7 | 9 | 3 | ··· |

FIG.12

| TRAY NAME | | TRAY 1 | TRAY 2 | TRAY 3 | TRAY 4 |
|---|---|---|---|---|---|
| SIZE | | A4 | A3 | A4 | A4R |
| PAPER TYPE | | PLAIN PAPER | PLAIN PAPER | PLAIN PAPER | COATED PAPER |
| PAPER WEIGHT[g/m$^2$] | | 62 - 71 | 210 - 244 | 62 - 71 | 40 - 49 |
| COLOR | | WHITE | WHITE | WHITE | WHITE |
| REFERENCE PROFILE NUMBER | | 01 | 02 | 01 | 03 |
| TRAY 1 | FLOATING UNIT | 4 | | | |
| | ADHERING UNIT | 7 | | | |
| TRAY 2 | FLOATING UNIT | | 8 | | |
| | ADHERING UNIT | | 9 | | |
| TRAY 3 | FLOATING UNIT | | | 4 | |
| | ADHERING UNIT | | | 7 | |
| TRAY 4 | FLOATING UNIT | | | | 2 |
| | ADHERING UNIT | | | | 3 |

FIG.13

| PROFILE NUMBER | | 01 | 02 | 03 | ··· |
|---|---|---|---|---|---|
| SIZE | | A4 | A3 | A4R | ··· |
| PAPER TYPE | | PLAIN PAPER | PLAIN PAPER | COATED PAPER | ··· |
| PAPER WEIGHT [g/m$^2$] | | 62 - 71 | 210 - 244 | 40 - 49 | ··· |
| COLOR | | WHITE | WHITE | WHITE | ··· |
| TRAY 1 | FLOATING UNIT | 4 | 8 | 2 | ··· |
| | ADHERING UNIT | 7 | 9 | 3 | ··· |
| TRAY 2 | FLOATING UNIT | 3 | 8 | 2 | ··· |
| | ADHERING UNIT | 5 | 9 | 3 | ··· |
| TRAY 3 | FLOATING UNIT | 3 | 8 | 2 | ··· |
| | ADHERING UNIT | 5 | 9 | 3 | ··· |
| TRAY 4 | FLOATING UNIT | 3 | 8 | 2 | ··· |
| | ADHERING UNIT | 5 | 9 | 3 | ··· |

FIG.14

| TRAY NAME | | TRAY 1 | TRAY 2 | TRAY 3 | TRAY 4 |
|---|---|---|---|---|---|
| SIZE | | A4 | A3 | A4 | A4R |
| PAPER TYPE | | PLAIN PAPER | PLAIN PAPER | PLAIN PAPER | COATED PAPER |
| PAPER WEIGHT[g/m$^2$] | | 62 - 71 | 210 - 244 | 62 - 71 | 40 - 49 |
| COLOR | | WHITE | WHITE | WHITE | WHITE |
| REFERENCE PROFILE NUMBER | | 01 | 02 | 01 | 03 |
| TRAY 1 | FLOATING UNIT | 4 | | | |
| | ADHERING UNIT | 7 | | | |
| TRAY 2 | FLOATING UNIT | | 8 | | |
| | ADHERING UNIT | | 9 | | |
| TRAY 3 | FLOATING UNIT | | | 3 | |
| | ADHERING UNIT | | | 5 | |
| TRAY 4 | FLOATING UNIT | | | | 2 |
| | ADHERING UNIT | | | | 3 |

IMAGE FORMING APPARATUS

BACKGROUND OF THE INVENTION

1. Field of the Invention

The present invention relates to an image forming apparatus.

2. Description of Related Art

In recent years, there has been known an image forming apparatus having a paper feed unit for separating paper sheets stacked in a paper feed tray from each other to carry the paper sheets one by one using air suction force.

For example, JP-A-07-101579 discloses a sheet feeding device including a sheet adhering unit for sucking air using air suction force so that each sheet adheres to a conveying unit; the conveying unit for carrying each sheet; an adhering preventing air spraying unit for spraying air on a tip of each sheet which adhered to the conveying unit; and an air adjusting unit for increasing or decreasing the quantity of air from the adhering preventing air spraying unit during sheet feeding. This sheet feeding device can prevent a next sheet from adhering to the conveying unit while carrying a previous sheet.

JP-A-10-315556 discloses a sheet feeding device including a floating unit for spraying air on stacked sheets to float each of the sheets; a suction unit for sucking air using air suction force so that each floated sheet adheres to a conveyor belt; a plurality of paper feed units each having a first air passageway through which the air to be supplied to the floating unit passes and a second air passageway through which the air from the suction unit passes; and an blower unit communicated with the first and second air passageways of each of the paper feed units to generate air for spraying and air for suction. The size or paper weight of each sheet stacked on a sheet stack unit is limited according to a distance from the blower unit to the paper feed unit.

JP-A-2001-80750 discloses a method of presetting a paper feed unit in which a preset table storing preset quantities which are set on the basis of paper quality data is created and a preset quantity corresponding to an input value of paper quality data is selected from the preset table. The paper quality data includes a paper type, a paper weight, a paper size and a paper texture. Examples of preset quantities include a supply quantity of air in separating paper sheets in a paper storage unit from each other by air, a supply quantity of air in stripping the paper sheets from the paper storage unit one by one, and a vacuum pressure of a vacuum adhering unit by which a paper sheet adheres to a feeder for conveyance.

In an image forming apparatus having a feeding device as shown in JP-A-7-101579 or JP-A-10-315556, however, a user has to manually configure a setting value such as an air flow quantity or a wind pressure for each paper feed unit as needed when changing the setting values which are preset in the feeding device. Therefore, even when the same type of paper sheets are stacked in a plurality of paper feed trays, the setting value must be manually changed for each paper feed tray, that is, for each paper feed unit. This could be a troublesome work.

An image forming apparatus having a function as disclosed in JP-A-2001-80750 is capable of selecting a setting value corresponding to a type of paper from setting values, such as an air flow quantity and a wind pressure, stored in an adjustment value table. Hence, it is possible to configure the same setting values with respect to a plurality of paper feed trays (that is, paper feed units) in which the same type of paper sheets are stacked. However, the setting values configured by a user cannot be reflected in the preset setting values. Therefore, even if the same type of paper sheets are stacked in a plurality of paper feed trays (that is, paper feed units), a user still has to do a troublesome work that requires a manual configuration of a setting value for each paper feed unit.

Furthermore, according to the above-described conventional techniques, the setting values may be different for different paper feed units even if the same type of paper sheets are stacked in the different paper feed units because of difference in mechanical condition such as clogging of a filter of a fan for sucking or discharging air into or from each paper feed unit. This may require change of setting value for each paper feed unit.

SUMMARY OF THE INVENTION

It is, therefore, a main object of the present invention to reduce a work load when changing a setting value of each paper feed unit and thus enhance operationality of an image forming apparatus.

According to one aspect of the present invention, there is provided an image forming apparatus including: a plurality of paper feed trays in which paper sheets are to be stacked and stocked; paper feed units each provided to each of the plurality of paper feed trays, the paper feed units sucking or discharging air in accordance with setting values corresponding to types of paper sheet to carry the paper sheets stacked in the respective paper feed trays toward a paper path; a storage unit to store the setting values for the paper feed units according to the types of paper sheet; an input unit to input a change instruction value for changing at least one of the setting values; and a control unit to change the at least one of the setting values stored in the storage unit into the change instruction value inputted through the input unit and to store the changed at least one of the setting values into the storage unit.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 3 is a diagram showing an example of a profile group;

FIG. 4 shows an example of a setting value table for each paper feed unit of each paper feed tray;

FIG. 11 shows an example of the profile group after an air assist condition registration button is selected;

FIG. 12 shows an example of the setting value table for each paper feed unit of each paper feed tray after the air assist condition registration button is selected;

FIG. 13 shows an example of the profile group after a tray-by-tray registration button is selected;

FIG. 14 shows an example of the setting value table for each paper feed unit of each paper feed tray after the tray-by-tray registration button is selected.

DESCRIPTION OF THE PREFERRED EMBODIMENTS

Preferred embodiments of the present invention will be explained below in detail with reference to the drawings.

First, a configuration of the embodiments will be described.

Figure 1:
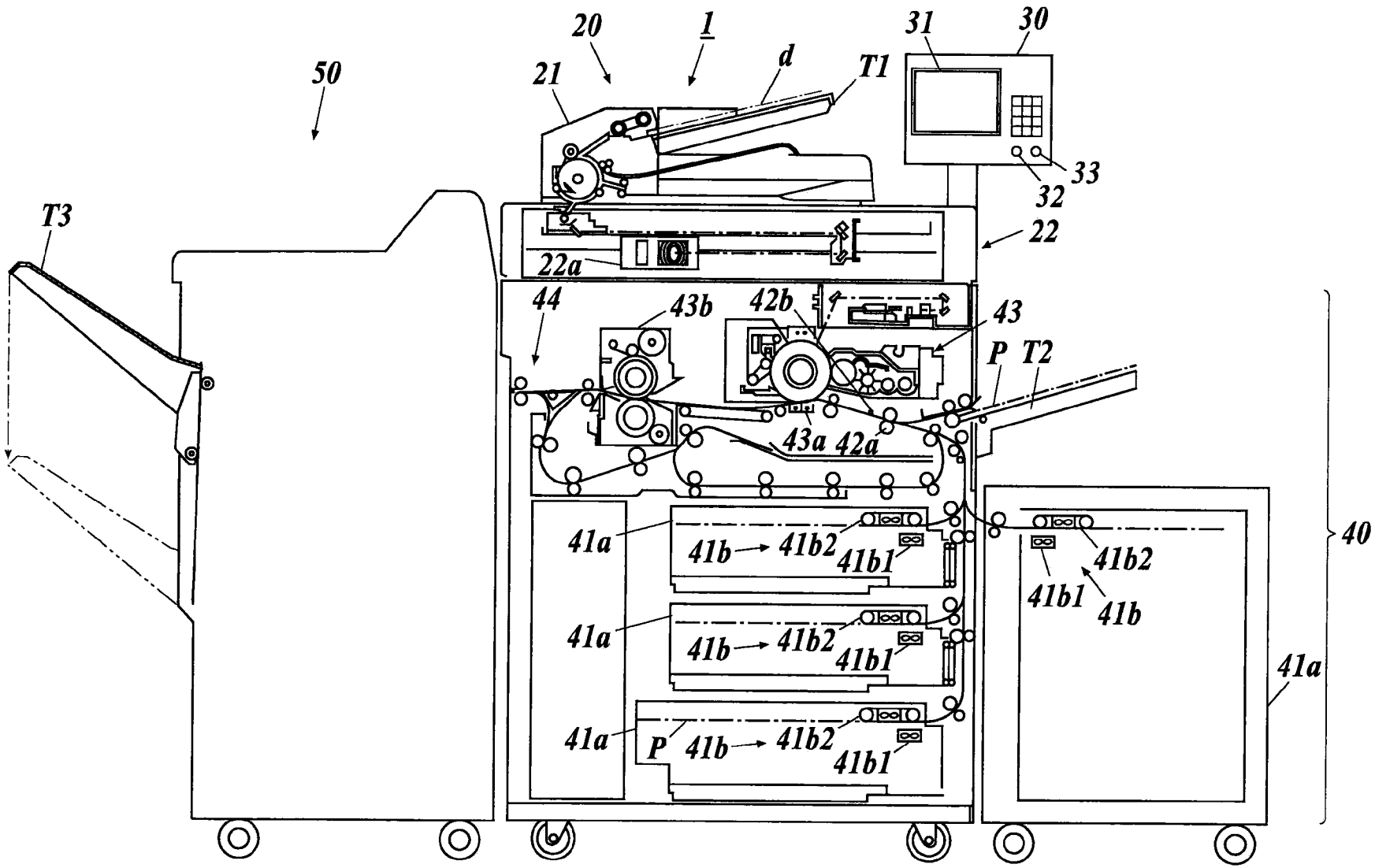
FIG. 1 shows a schematic cross-sectional view of an image forming apparatus according to preferred embodiments of the present invention.

FIG. 1 shows a schematic cross-sectional view of an image forming apparatus 1 according to the embodiments.

As shown in FIG. 1, the image forming apparatus 1 is a digital complex machine having a main body unit 1*a* and a post-processing device 50. The main body unit 1*a* reads out an image of a document (original) to form the read-out image on a paper sheet P. The main body unit 1*a* also receives job information of a job from an external device to form an image on a paper sheet P based on the received job information. The job information contains page data including image data and setting information such as an image forming condition of each image data. The post-processing device 50 conducts a post-processing on a paper on which an image is formed. The main body 1*a* includes an image reading unit 20, an operation display unit 30 and a printing unit 40.

The image reading unit 20 has an automatic document feeding unit 21 called as auto document feeder (ADF) and a reading unit 22. The image reading unit 20 reads images of a plurality of documents based on setting information (described later) which is accepted by the operation display unit 30. A document d placed on a document tray T1 of the automatic document feeding unit 21 is carried onto a contact glass as a reading place. An image or images on one surface or both surfaces of the document d are read on the contact glass by an optical system, and converted to an image signal by a charge coupled device (CCD) 22*a*. Here, examples of an image include not only image data of a figure or a photograph, but also text data of characters or symbols.

The data of the image (analog image signal) read by the image reading unit 20 is outputted to a reading processing unit 140 of an image control board (described later), converted to digital signal by the reading processing unit 140, subjected to various kinds of image processing, and then outputted to the printing unit 40.

The operation display unit 30 includes a liquid crystal display (LCD), a touch panel 31 which is provided so as to cover the LCD, a start button 32, a check button 33, and an operation key group (not shown). The operation display unit 30 accepts an input by a user, and outputs the input information to a control unit 110 (described later). Moreover, the operation display unit 30 displays various kinds of setting screens for entering various kinds of setting conditions, and also displays various kinds of processing results, in accordance with a display signal from the control unit 110.

The start button 32 accepts an instruction for executing a predetermined operation in the image forming apparatus 1. When the start button 32 is pushed, execution of the predetermined operation commences.

As one of operations in the image forming apparatus 1, the check button 33 functions as an check instruction unit for entering an instruction to execute checking processing (proof mode) of operations in the image forming apparatus 1 in order to check the operation of image formation by the printing unit 40. By pushing the check button 33, the execution of the proof mode is set.

A basic screen G1 (see FIG. 7), a machine status screen G2 (see FIG. 8), an auto/manual screen G3 (see FIG. 9), an air assist condition setting screen G4 (see FIG. 10) and a check screen G5 (see FIG. 15) are displayed on the touch panel 31 of the operation display unit 30. The operation display unit 30 outputs an operation signal indicating an instruction accepted by each of these screens to the control unit 110 (described later).

The printing unit 40 includes a paper storage unit 41, a paper conveying unit 42, an image forming unit 43, and a paper discharge unit 44. The printing unit 40 executes image forming processing by an electrophotographic method on the basis of input print data.

The paper storage unit 41 has a plurality of paper feed trays 41*a*, a plurality of paper feed units 41*b*, and a bypass tray T2. Paper sheets P are identified according to types of paper sheets. Different types of paper sheets P are stacked in different paper feed trays 41*a*.

Various types of paper sheets P can be stacked on the bypass tray T2 in accordance with user needs, and the stacked paper sheets P are fed into the paper conveying unit 42 one by one by a paper feed roller starting with an uppermost paper sheet of the stacked paper sheets P.

For each paper feed tray 41*a*, there is provided one paper feed unit 41*b*. Each of the paper feed units 41*b* sucks or discharges air in accordance with a setting value corresponding to a type of paper sheets stacked in a corresponding paper feed tray 41*a*, and carries the paper sheets stacked in the corresponding paper feed tray 41*a* one by one toward the paper conveying unit 42 starting with an uppermost paper sheet of the paper sheets.

Each of the paper feed units 41*b* of the embodiments has a floating unit 41*b*1, an adhering unit 41*b*2 and a tip roller.

The floating unit 41*b*1 has an exhaust fan, a nozzle and a mechanism capable of adjusting an air flow quantity exhausted from the nozzle. In the floating unit 41*b*1, air is sprayed from the nozzle from a direction perpendicular to the conveying direction of paper sheets, which were stacked on the paper feed tray 41*a*, at an air flow quantity corresponding to the setting value, thereby floating each of the paper sheets.

The adhering unit 41*b*2 has an air suction fan, a conveyor belt, a nozzle and a mechanism capable of adjusting an air suction flow quantity by the nozzle. In the adhering unit 41*b*2, an uppermost paper sheet, which is stacked on the paper feed tray 41*a* and floated by the floating unit 41*b*1, adheres to the conveyor belt by sucking air through the nozzle at an air flow quantity corresponding to the setting value, and the paper sheet adhering to the conveyor belt is fed into the paper conveying unit 42.

The tip roller pinches a tip of the paper sheet adhering to the conveyor belt to separate the paper sheet from the conveyor belt so that the paper conveying unit 42 can carry the paper sheet.

The paper conveying unit 42 carries the paper sheet P from one of the paper feed trays 41*a* or the bypass tray T2 toward a transfer unit 43*a* through a plurality of intermediate rollers, resist rollers 42*a*.

The paper conveying unit 42 carries the one-side image formed paper sheet P to a duplexing paper path by a paper path switching plate, and carries the paper sheet P again toward the transfer unit 43*a* through the intermediate rollers, and the resist rollers 42*a*.

The image forming unit 43 has a photosensitive drum, a charging unit, an exposure unit, a developing unit, the transfer unit 43*a*, a cleaning unit and a fixing unit 43*b*. The exposure unit includes a laser output section for outputting laser light based on image data and a polygon mirror for laser scanning in a main scanning direction. The image forming unit 43 forms an image on a paper sheet based on job information stored in a RAM 130 (described later).

Specifically, the photosensitive drum charged by the charging unit is irradiated with laser light by the exposure unit to form an electrostatic latent image on the photosensitive drum. A charged toner adheres to a surface of the photosensitive drum, on which the electrostatic latent image is formed, by the developing unit so as to develop the electrostatic latent image. The toner image formed on the photosensitive drum by the developing unit is transferred onto the paper sheet P in the transfer unit 43*a*. After the toner image is transferred to the paper sheet P, the residual toner on the surface of the photosensitive drum is removed by the cleaning unit.

The fixing unit 43*b* thermally fixes the toner image transferred onto the paper sheet P which has been carried by the paper feed unit 42. The thermally fixed paper sheet P is pinched by paper discharge rollers of the paper discharge unit 44 and carried from a discharge opening to the post-processing device 50.

The post-processing device 50 has a post-processing unit and an output tray T3. Examples of the post-processing unit include a sort unit for sorting paper sheets on which images are formed, a punch unit for punching the paper sheets, a staple unit for stapling a stack of paper sheets at one or more preset positions, a folding unit for folding the paper sheets, and a cutting unit for cutting the paper sheets. Paper sheets, on which images are formed by the main body unit 1*a* or which are subjected to various kinds of post-processing, are discharged and stacked on the output tray T3.

Figure 2:
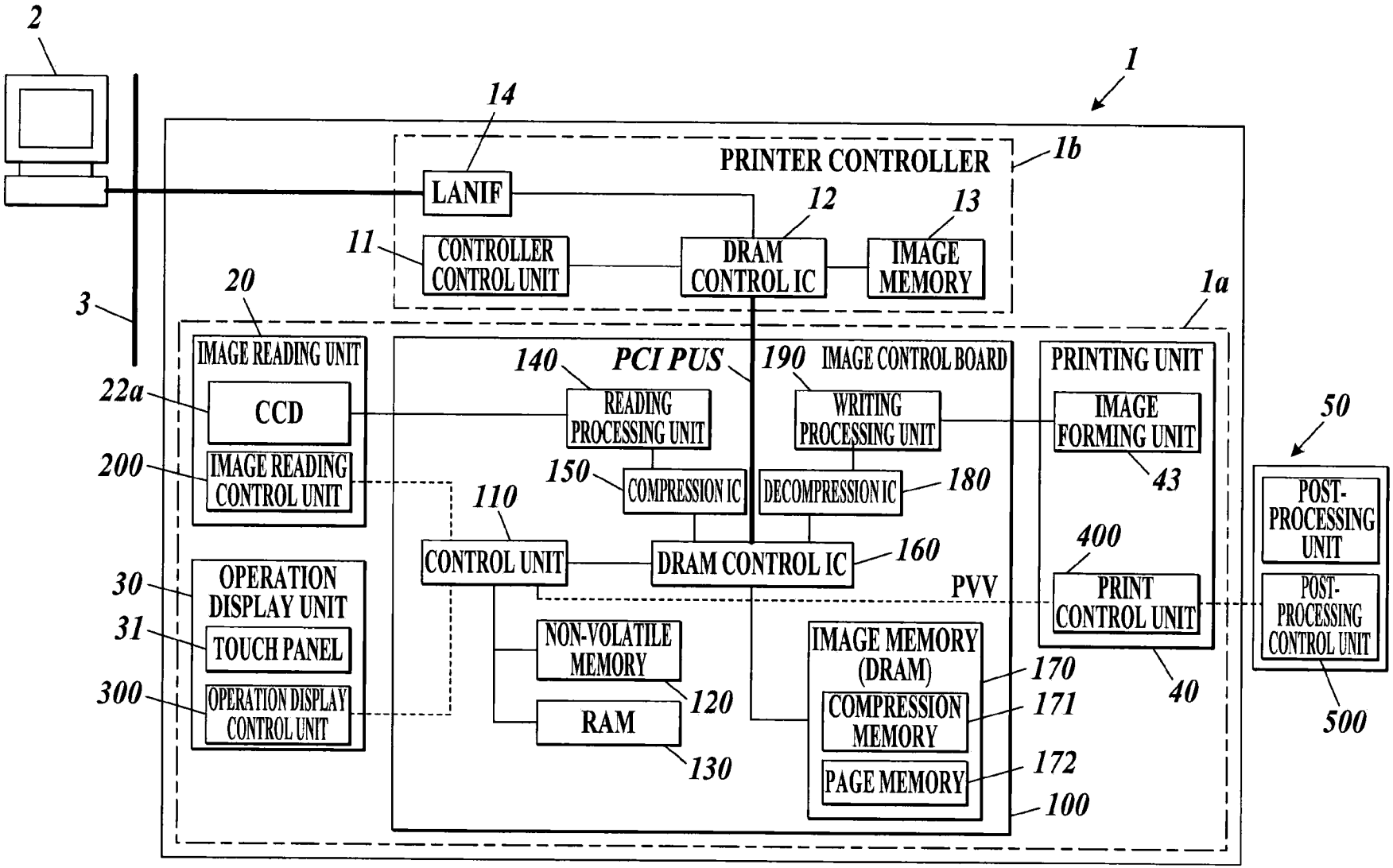
FIG. 2 is a control block diagram of the image forming apparatus.

FIG. 2 is a control block diagram of the image forming apparatus 1.

As shown in FIG. 2, the image forming apparatus 1 includes the main body unit 1*a*, a printer controller 1*b*, and the post-processing device 50 connected to the main body unit 1*a*. The image forming apparatus 1 is connected to an external device 2 on a network 3 through a local area network interface (LANIF) 14 of the printer controller 1*b* so that information can be sent and received between the image forming apparatus 1 and the external device 2.

The main body unit 1*a* includes an image reading unit 20, the operation display unit 30, the printing unit 40 and an image control board 100. The same reference numerals will be used in FIGS. 1 and 2 to refer to the same elements without adding explanation.

On the image control board 100, there are provided the control unit 110, a non-volatile memory 120, a random access memory (RAM) 130, the reading processing unit 140, a compression IC 150, a dynamic random access memory (DRAM) control IC 160, an image memory 170, a decompression IC 180 and a writing processing unit 190.

The control unit 110 includes a central processing unit (CPU). The control unit 110 reads out a specified program from a system program and various kinds of application programs stored in the non-volatile memory 120, loads the designated program into the RAM 130, carries out various kinds of processing in cooperation with the program loaded into the RAM 130, and thereby controlling the respective units of the image forming apparatus 1.

For example, in accordance with an instruction signal from the operation display unit 30 or the external device 2, the control unit 110 switches from one of a copy mode, a printing mode and a scanner mode to another for copying, printing, or reading of image data.

Setting values of air flow quantities in the floating unit 41*b* and the adhering unit 41*b*2 are predefined according to types of paper sheets and the paper feed units 41*b*, and stored in the non-volatile memory 120. By cooperation between various kinds of data and an air assist condition setting processing program which is read out from the non-volatile memory 120, the control unit 110 changes the setting values of air flow quantities in the floating unit 41*b* and the adhering unit 41*b*2 into change instruction values specified through the air assist condition setting screen G4 on the LCD of the operation display unit 30, and stores the changed setting values into the non-volatile memory 120.

In the air assist condition setting processing, when an air assist condition registration button is selected on the air assist condition setting screen G4, the control unit 110 changes the setting values corresponding to a type of paper sheets stacked in the paper feed tray 41*a* provided with the paper feed unit 41*b* whose setting values are to be changed, into the change instruction values specified through the air assist condition setting screen G4 on the LCD of the operation display unit 30, and then stores the changed setting values into the non-volatile memory 120.

In the air assist condition setting processing, when a tray-by-tray registration button is selected on the air assist condition setting screen G4, the control unit 110 changes the setting values corresponding to a type of paper sheets stacked in the paper feed tray 41*a* provided with the paper feed unit 41*b* whose setting values are to be changed and corresponding to the paper feed unit 41*b* provided to the paper feed tray 41*a*, into the change instruction values specified through the air assist condition setting screen G4 on the LCD of the operation display unit 30, and then stores the changed setting values into the non-volatile memory 120.

Furthermore, when an instruction for executing the proof mode is entered, the control unit 110 executes the checking processing, and then accepts an input of at least one change instruction value for changing at least one of the setting values through the operation display unit 30. The check processing contains a processing of feeding at least one paper sheet into the paper path by one of the paper feed units 41*b* based on the setting values of the one of the paper feed units stored in the non-volatile memory 120.

The non-volatile memory 120 as a storage unit stores various kinds of processing programs and data associated with image formation, data processed in accordance with various kinds of programs, the air assist condition setting processing program, a profile group having setting values for each type of paper sheet and each paper feed unit, and setting values for each paper feed unit of each paper feed tray.

FIG. 3 shows an example of the profile group.

As shown in FIG. 3, the profile group includes a plurality of profiles in which setting values of air flow quantity are set for each paper feed unit (for each floating unit and adhering unit in each paper feed unit) with respect to each type of paper sheet. The types of paper sheet are classified according to size, paper types, paper weight and color of paper sheet. The paper types can be separated into plain (uncoated) paper and coated paper according to material and property of paper sheet. A different identification number (profile number) for identifying each profile is allocated to each profile.

For example, in the profile of profile number "01", setting values of air flow quantity for the floating units 41*b*1 of the respective paper feed trays 1 to 4 are set to 3, and setting values of air flow quantity for the adhering units 41*b*2 of the respective paper feed trays 1 to 4 are set to 5 in case of the following types of paper sheet: size of paper sheet is A4; paper type is plain paper; paper weight is in a range of 62 to 71 (g/m$^2$); and color is white. Initial values of these setting values are predefined according to paper types and paper weight of paper sheet.

FIG. 4 shows an example of a setting value table for each paper feed unit of each paper feed tray.

As shown in FIG. 4, in the setting value table, a tray name for identifying each paper feed tray, types of paper sheets stacked in the respective paper feed trays (the types of paper sheet are classified according to size, paper types, paper weight and color of paper sheet), profile numbers for reference (reference profile numbers) corresponding to the types of paper sheet, and setting values of floating unit and adhering unit in target paper feed tray out of profiles defined by reference profile numbers, are set for each paper feed tray.

For example, with respect to a tray 1 and a tray 3, the types of paper sheet of the respective trays both correspond to profile number "01" in FIG. 3. Therefore, the reference profile numbers of the respective trays are both set to "01" in the setting table. Moreover, setting values 3 and 5 of floating unit and adhering unit in the tray 1 with profile number "01" are set in the setting value table as setting values of the floating unit and adhering unit in the tray 1, and setting values 3 and 5 of floating unit and adhering unit in the tray 3 with profile number "01" are set in the setting table as setting values of the floating unit and adhering unit in the tray 3.

The RAM 130 has a working area for temporarily storing various programs executed by the control unit 110 and various data associated with these programs.

The reading processing unit 140 executes various processing such as analog processing, analog-to-digital conversion and shading with respect to an analog image signal from an image reading control unit 200 of the image reading unit 20, and then generates digital image data. The generated image data is outputted to the compression IC 150.

The compression IC 150 compresses the input digital image data and outputs the compressed digital image data to the DRAM control IC 160.

The DRAM control IC 160 controls the compression of the image data by the compression IC 150 and the decompression of the compressed image data by the decompression IC 180, and also controls an input and output of the image data to and from the image memory 170, according to an instruction from the control unit 110.

For example, when an instruction to store an image signal obtained from the image reading unit 20 is given, the DRAM control IC 160 causes the compression IC 150 to compress the image data from the reading processing unit 140, and stores the compressed image data into a compression memory 171 of the image memory 170. When an instruction to print out the compressed image data stored in the compression memory 171 is given, the DRAM control IC 160 reads out the compressed image data from the compression memory 171, causes the decompression IC 180 to decompress the compressed image data, and stores the decompressed image data into a page memory 172. When an instruction to print out the image data stored in the page memory 172 is given, the DRAM control IC 160 reads out the image data from the page memory 172, and outputs the image data to the writing processing unit 190.

The image memory 170 includes the compression memory 171 and the page memory 172 which have dynamic RAMs (DRAMs). The compression memory 171 is a memory for storing compressed image data. The page memory 172 is a memory for temporarily storing image data (print data) for print output.

The decompression IC 180 decompresses the compressed image data.

The writing processing unit 190 generates print data for image formation based on the image data from the DRAM control IC 160, and outputs the generated print data to the printing unit 40.

The image reading unit 20 includes a CCD 22*a*, the image reading control unit 200, the automatic document feeding unit 21 and the reading unit 22 (the automatic document feeding unit 21 and the reading unit 22 are shown in FIG. 1). The image reading control unit 200 reads an image of the document by controlling the automatic document feeding unit 21 and the reading unit 22 to expose and scan the document, and by causing the CCD 22*a* to execute photoelectric conversion with respect to the reflected light obtained when the document is irradiated with light. The analog image signal obtained by reading the image of the document is outputted to the reading processing unit 140.

The operation display unit 30 includes the touch panel 31, an operation display control unit 300, the start button 32, the check button 33 (the start button 32 and the check button 33 are shown in FIG. 1), and an operation key group such as a ten key. The operation display control unit 300 causes the LCD to display a wide variety of screens for entering various setting conditions and a wide variety of processing results according to a display signal inputted from the control unit 110. Moreover, the operation display control unit 300 outputs operation signals from various switches, the buttons, the operation key group or the touch panel 31, to the control unit 110.

The printing unit 40 includes various units related to printing such as the image forming unit 43 shown in FIG. 1, and a print control unit 400. The print control unit 400 controls operations of the respective units of the printing unit 40 such as the image forming unit 43 according to an instruction from the control unit 110, and forms an image on a paper sheet P based on print data from the writing processing unit 190. In addition, the print control unit 400 outputs an instruction signal to the post-processing device 50 according to an instruction from the control unit 110 so that the respective units of the post-processing device 50 operate.

The post-processing device 50 includes various post-processing units, a conveyance unit such as rollers for carrying paper sheets toward the post-processing units, and the output tray T3 for outputting the paper sheets carried from the post-processing units. The respective post-processing units are controlled overall by a post-processing control unit 500. Under the control of the post-processing control unit 500, a paper sheet P is carried along a paper path toward a predetermined post-processing unit, and predetermined post-processing is performed with respect to the paper sheet P, and then the paper sheet P is carried toward the output tray T3.

Next, each unit of the printer controller 1*b* will be described. The printer controller 1*b* manages and controls a job inputted from the external device 2 connected to the network 3 to the image forming device 1 when the image forming device 1 is used as a network printer. The printer controller 1*b* receives data to be printed and sends the data as a job to the main body unit 1*a*.

The printer controller 1*b* includes a controller control unit 11, a DRAM control IC 12, an image memory 13 and a LANIF 14.

The controller control unit 11 controls overall operations of the respective units of the printer controller 1*b*, and sends data from the external device 2 through the LANIF 14 to the main body unit 1*a* as a job.

The DRAM control IC 12 controls storing of data received through the LANIF 14 into the image memory 13 and reading of data from the image memory 13. The DRAM control IC 12 is connected to the DRAM control IC 160 of the image control board 100 through a PCI (peripheral components interconnect) bus. The DRAM control IC 12 reads out data to be printed from the image memory 13 and outputs the data to be printed to the DRAM control IC 160 according to an instruction from the controller control unit 11.

The image memory 13 includes a DRAM, and temporarily stores output data inputted thereto.

The LANIF 14 is a communication interface such as a network interface card (NIC) and a modem for connecting the image forming apparatus 1 to the network 3 such as LAN. The LANIF 14 receives data from the external device 2. The received data is outputted to the DRAM control IC 12.

Next, operations of the embodiments will be described.

Figure 5:
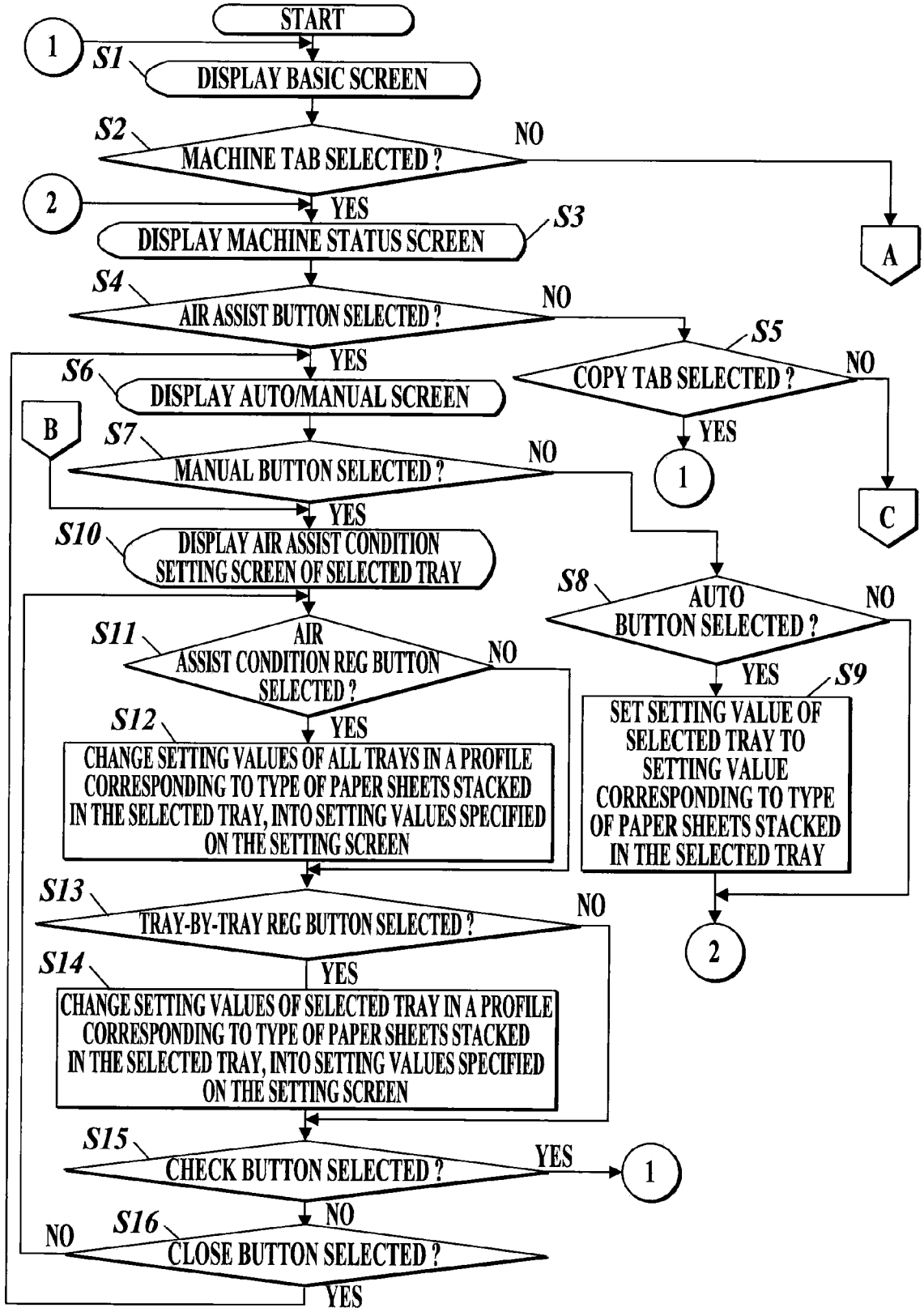
FIG. 5 shows a flowchart depicting an air assist condition setting processing according to the embodiments.
Figure 6:
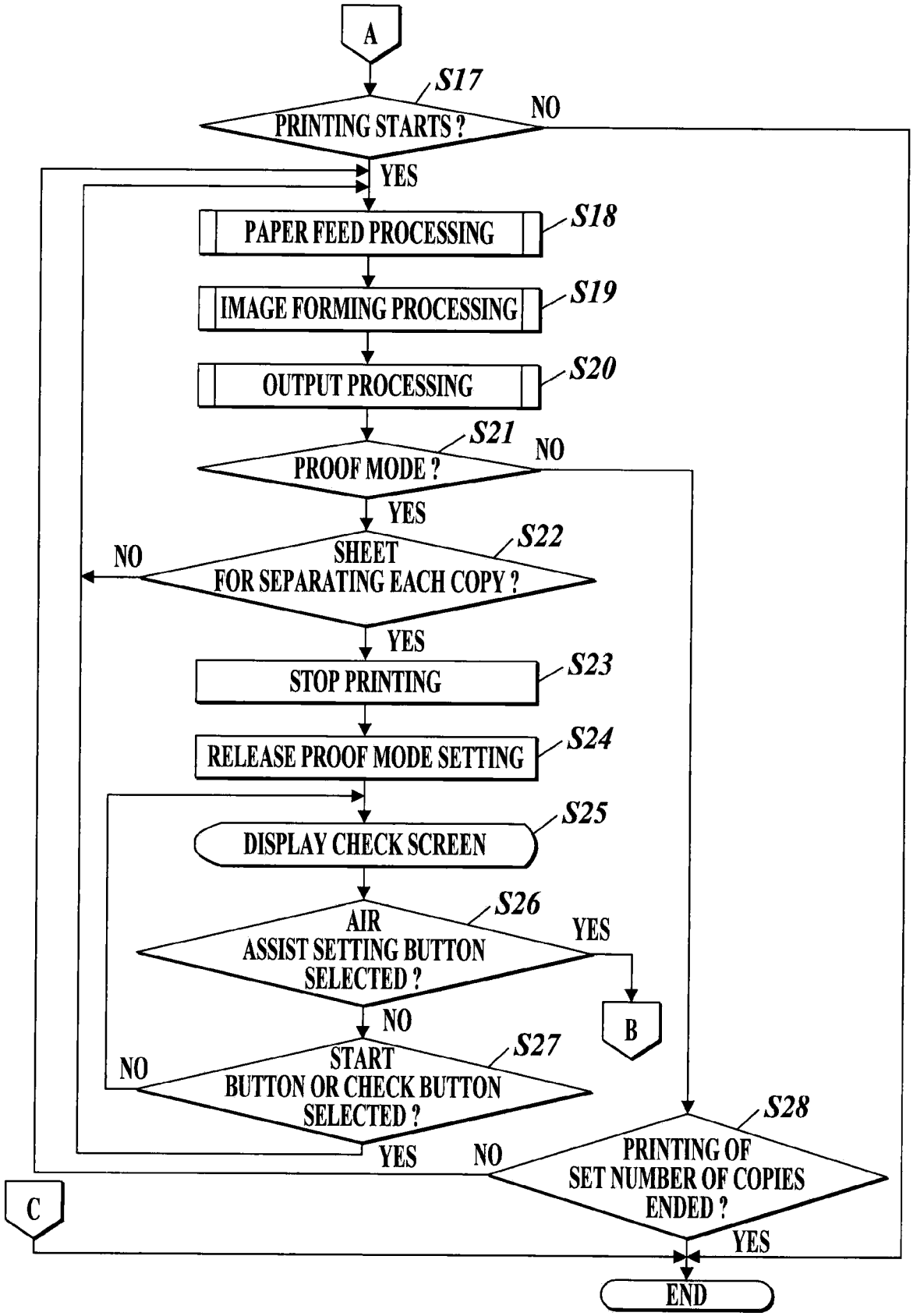
FIG. 6 shows a flowchart (subsequent to the flowchart of FIG. 5) depicting the air assist condition setting processing according to the embodiments.

FIGS. 5 and 6 show flowcharts depicting the air assist condition setting processing according to the embodiments. Steps depicted in the flowcharts of FIGS. 5 and 6 are executed under the control of the control unit 110.

First, the control unit 110 causes the operation display unit 30 to display a basic screen on the LCD (step S1).

Figure 7:
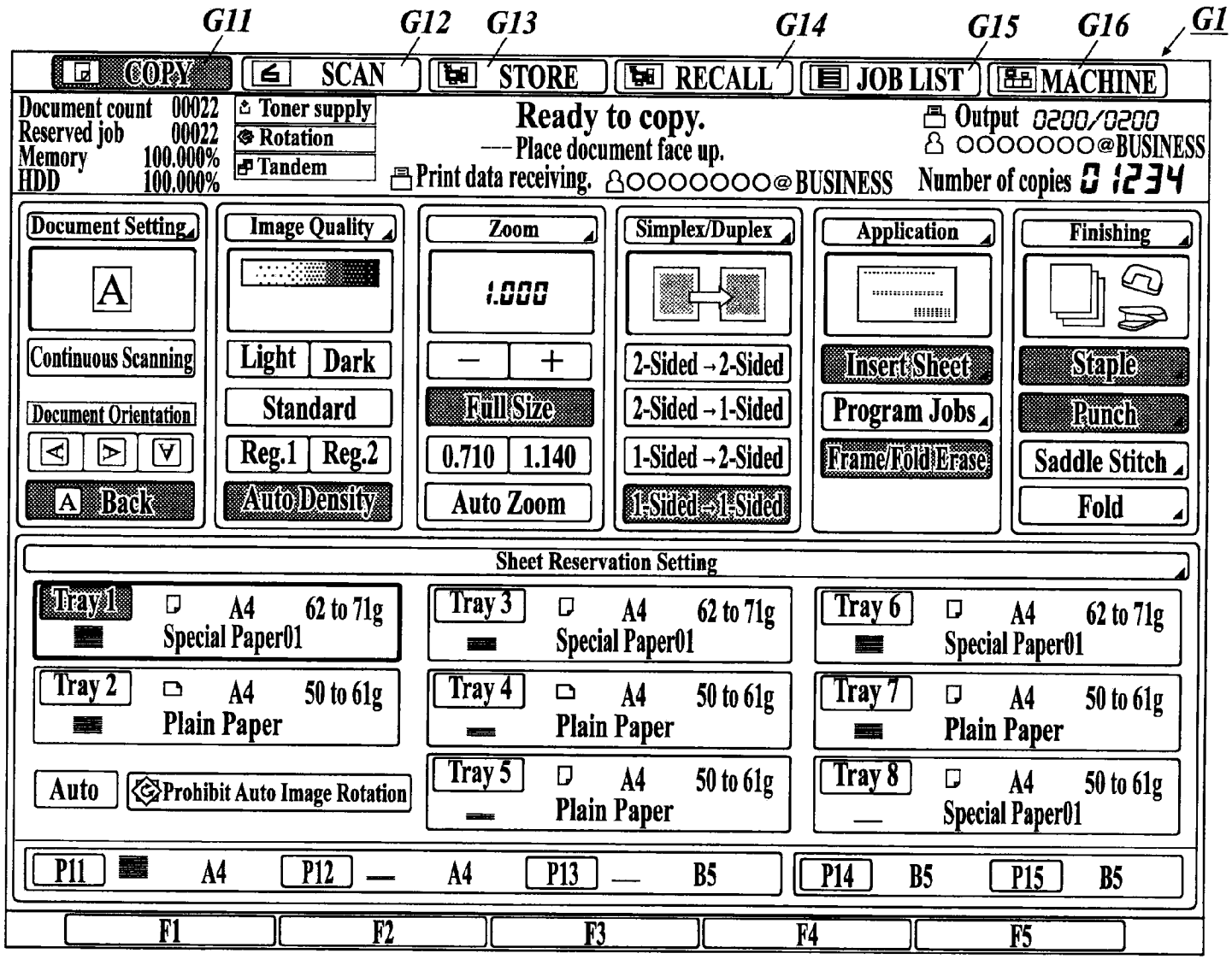
FIG. 7 shows an example of a basic screen.

FIG. 7 shows an example of the basic screen G1.

As shown in FIG. 7, the basic screen G1 is a screen for displaying various settings and for accepting changes of the settings when executing a job. The basic screen G1 has a "copy" tab G11, a "scan" tab G12, a "store" tab G13, a "recall" tab G14, a "job list" tab G15, and a "machine" tab G16. The basic screen G1 shown in FIG. 7 appears on the LCD when the copy tab G11 is selected.

The control unit 110 determines whether the machine tab G16 is selected on the basic screen G1 (step S2). If the machine tab G16 is selected (step S2; Yes), the control unit 110 causes the operation display unit 30 to display a machine status screen on the LCD (step S3).

Figure 8:
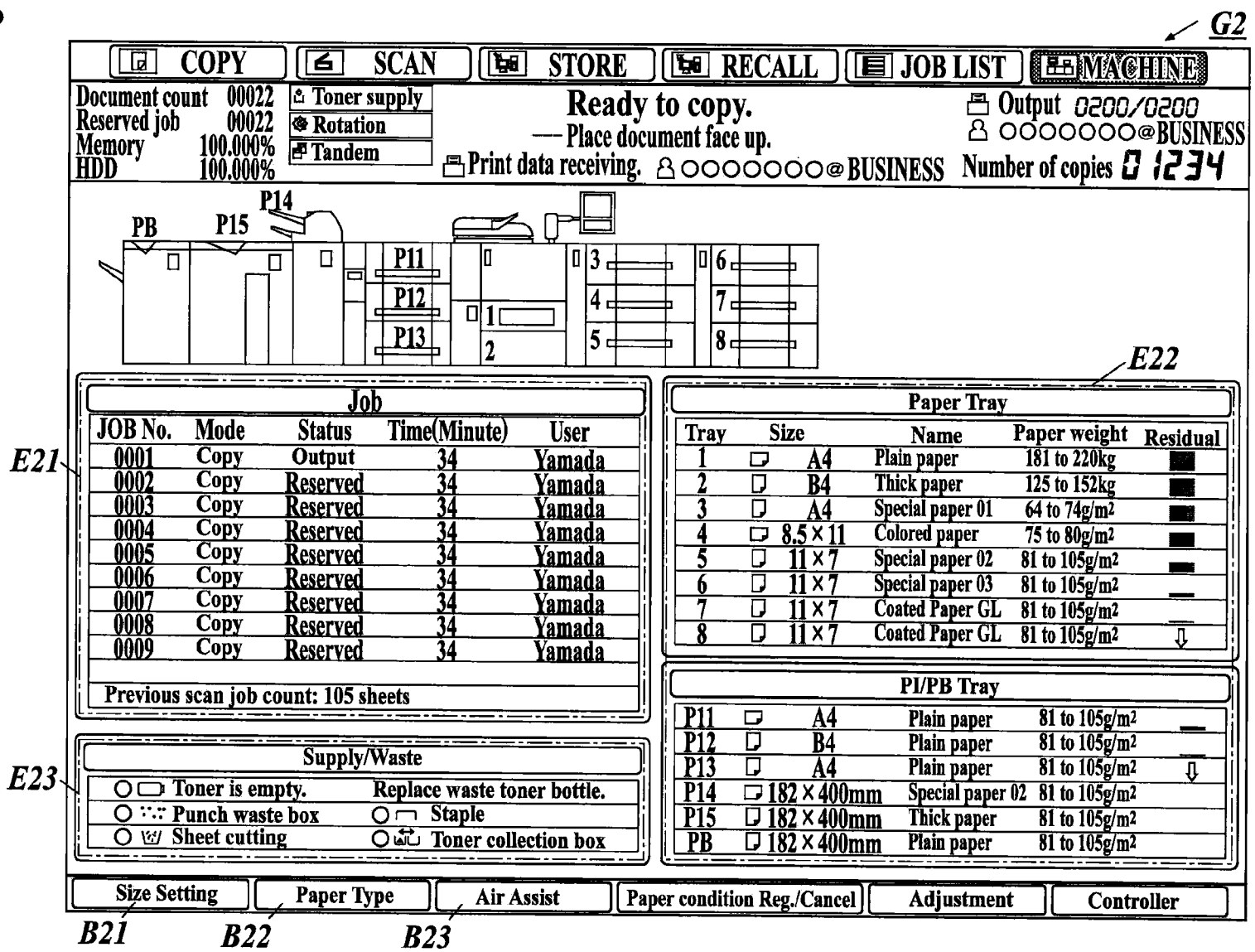
FIG. 8 shows an example of a machine status screen.

FIG. 8 shows an example of the machine status screen G2.

As shown in FIG. 8, the machine status screen G2 has a job list area E21, a paper tray area E22, a supply/waste area E23, a size setting button B21, a paper type button B22, and an air assist button B23.

The job list area E21 shows a list of reserved jobs.

The paper tray area E22 shows statuses of the respective paper feed trays (e.g., types of paper sheets and remaining paper sheets stacked in the respective paper feed trays) in the image forming apparatus 1. The paper tray area E22 functions as a tray selection unit for entering an instruction to select at least one of the paper feed trays provided to at least one of the paper feed units whose setting values are to be changed.

The supply/waste area E23 shows statuses of supply members such as toners and staples and waste members such as punch waste.

The size setting button B21 is a button for displaying a screen for changing a size of paper sheets stacked in the selected at least one of the paper feed trays which appear on the paper tray area E22.

The paper type button B22 is a button for displaying a screen for changing a paper type of paper sheets stacked in the selected at least one of the paper feed trays which appear on the paper tray area E22.

The air assist button B23 is a button for displaying a screen for changing setting values of air flow quantities of at least one of the paper feed units corresponding to the selected at least one of the paper feed trays which appear on the paper tray area E22.

The control unit 110 determines whether (at least) one of the paper feed trays on the paper tray area E22 is selected and the air assist button B23 is selected on the machine status screen G2 (step S4).

If the air assist button B23 is not selected (step S4; No), the control unit 110 determines whether the copy tab G11 is selected (step S5). If the copy tab G11 is selected (step S5; Yes), the control unit 110 returns to step S1.

If the copy tab G11 is not selected (step S5; No), for example, if the size setting button B21 is selected, the control unit 110 proceeds to selected processing, and then terminates the air assist condition setting processing.

If the air assist button B23 is selected (step S4; Yes), the control unit 110 causes the operation display unit 30 to display the auto/manual screen on the LCD (step S6).

Figure 9:
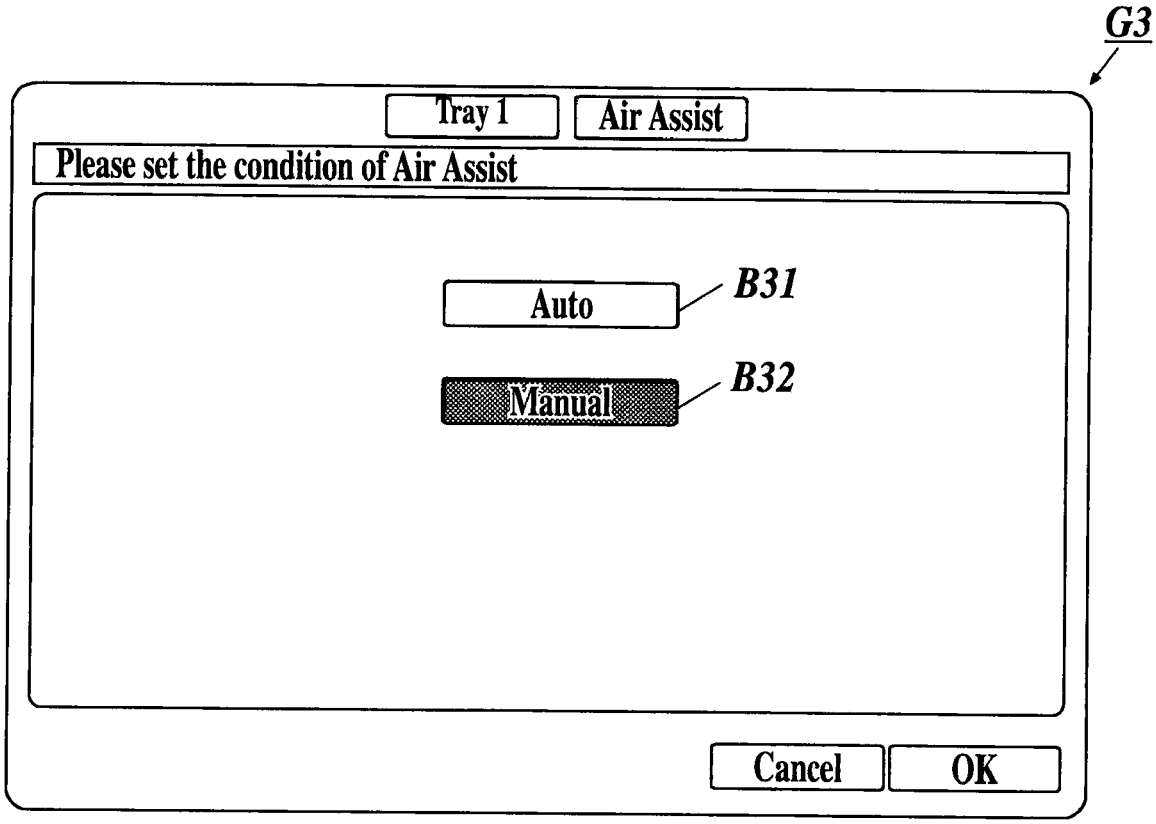
FIG. 9 shows an example of an auto/manual screen.

FIG. 9 shows an example of the auto/manual screen G3.

As shown in FIG. 9, the auto/manual screen G3 has an auto button B31 and a manual button B32.

The auto button B31 accepts an instruction to set setting values of a paper feed unit provided to the paper feed tray selected in step S4 (hereinafter referred to as "selected tray") to setting values in a profile corresponding to the selected tray and a type of paper sheets stacked in the selected tray.

The manual button B32 is a button for displaying the air assist condition setting screen on which a user can arbitrarily change the setting values of the paper feed unit provided to the selected tray.

The control unit 110 determines whether the manual button B32 is selected on the auto/manual screen G3 (step S7).

If the manual button B32 is not selected on the auto/manual screen G3 (step S7; No), the control unit 110 determines whether the auto button B31 is selected (step S8). If the auto button B31 is selected (step S8; Yes), the control unit 110 sets setting values of air flow quantities of the floating unit and adhering unit in the paper feed unit provided to the selected tray, to setting values of the floating unit and adhering unit provided to the selected tray in one profile corresponding to a type of paper sheets stacked in the selected tray out of the profile group stored in the non-volatile memory 120 (step S9).

If the auto button B31 is not selected (step S8; No) or after step S9, the control unit 110 returns to step S3.

If the manual button B32 is selected on the auto/manual screen G3 (step S7; Yes), the control unit 110 causes the operation display unit 30 to display the air assist condition setting screen of the selected tray on the LCD (step S10).

Figure 10:
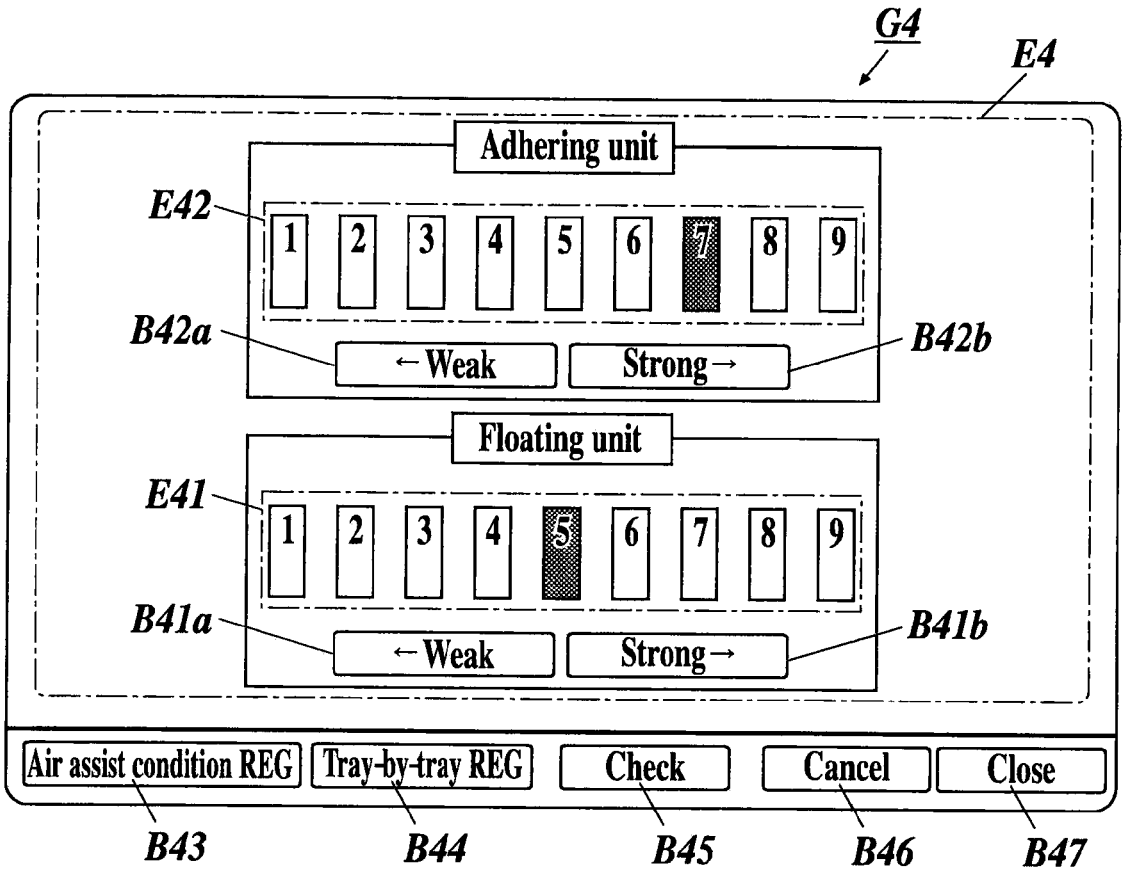
FIG. 10 shows an example of an air assist condition setting screen.

FIG. 10 shows an example of the air assist condition setting screen G4.

The air assist condition setting screen G4 shown in FIG. 10 is a screen for changing settings of air flow quantities of the floating unit and adhering unit in the paper feed unit provided to the selected tray. The air assist condition setting screen G4 functions as an input unit for entering a change instruction value for changing at least one of the setting values.

As shown in FIG. 10, the air assist condition setting screen G4 has a setting value instruction area E4, an air assist condition registration button B43, a tray-by-tray registration button B44, a check button B45, a cancel button B46 and a close button B47.

The setting value instruction area E4 has a weak button B41*a* and a strong button B41*b* for changing the setting value of the air flow quantity of the floating unit provided to the selected tray, a setting value display area E41 for displaying the setting value of the air flow quantity set for the floating unit, a weak button B42*a* and a strong button B42*b* for changing the setting value of the air flow quantity of the adhering unit provided to the selected tray, and a setting value display area E42 for displaying the setting value of the air flow quantity set for the adhering unit.

The air assist condition setting screen G4 allows a user to change the setting value of the air flow quantity of the floating unit provided to the selected tray by using the weak button B41*a* or the strong button B41*b* while viewing the setting value display area E41. Moreover, the air assist condition setting screen G4 allows a user to change the setting value of the air flow quantity of the adhering unit provided to the selected tray by using the weak button B42*a* or the strong button B42*b* while viewing the setting value displaying area E42. Accordingly, the setting value instruction area E4 functions as a setting value instruction section for entering a change instruction value for changing at least one of the setting values corresponding to a type of paper sheets stacked in the selected tray.

The air assist condition registration button B43 functions as a first registration section for entering an instruction to change the setting values corresponding to a type of paper sheets stacked in the selected tray into change instruction values specified through the setting value instruction area E4.

The tray-by-tray registration button B44 functions as a second registration section for entering an instruction to change the setting values corresponding to a type of paper sheets stacked in the selected tray and corresponding to the paper feed unit provided to the selected tray, into change instruction values specified through the setting value instruction area E4.

The check button B45 functions as a check instruction unit for entering an instruction to execute checking processing (proof mode) of operations in the image forming apparatus 1 in order to check feeding operations based on the setting values set through the air assist condition setting screen. By touching the check button B45, the execution of the proof mode is set.

The control unit 110 determines whether the air assist condition registration button B43 is selected on the air assist condition setting screen G4 (step S11).

If the air assist condition registration button B43 is selected on the air assist condition setting screen G4 (step S11; Yes), the control unit 110 changes setting values of all the paper feed units in a profile corresponding to a type of paper sheets stacked in the selected tray, into the change instruction values specified through the setting value instruction area E4, and stores the changed setting values into the non-volatile memory 120 (step S12).

FIG. 11 shows an example of a profile group after the air assist condition registration button B43 is selected.

Assuming that FIG. 3 shows an example of the profile group before the air assist condition registration button B43 is selected, the profile group will be changed as shown in FIG. 11 under the following conditions: a type of paper sheets stacked in the selected tray corresponds to profile number "01"; a change instruction value "4" is specified with respect to a floating unit on the setting value instruction area E4 of the air assist condition setting screen G4; and a change instruction value "7" is specified with respect to an adhering unit on the setting value instruction area E4. That is, as shown in FIG. 11, the setting values of the floating units and adhering units of all the trays 1 to 4 with respect to profile number "01" are changed into the change instruction values "4" and "7", respectively.

Accordingly, in the setting value table, the setting values of the paper feed units of the paper feed trays referring to this profile number "01" will be changed.

FIG. 12 shows an example of the setting value table for each paper feed unit of each paper feed tray after the air assist condition registration button B43 is selected.

Since the setting values of the floating units and adhering units of all the trays 1 to 4 with respect to profile number "01" are changed into "4" and "7", respectively in the profile group, the setting values of the floating units and adhering units of the trays 1 and 3 corresponding to reference profile number "01" are changed into "4" and "7", respectively in the setting value table as shown in FIG. 12.

If the air assist condition registration button B43 is not selected on the air assist condition setting screen G4 (step S11; No) or after step S12, the control unit 110 determines whether the tray-by-tray registration button B44 is selected (step S13).

If the tray-by-tray registration button B44 is selected on the air assist condition setting screen G4 (step S13; Yes), the control unit 110 only changes setting values corresponding to the paper feed unit provided to the selected tray in the profile corresponding to a type of paper sheets stacked in the selected tray, into the change instruction values specified through the setting value instruction area E4, and stores the changed setting values into the non-volatile memory 120 (step S14).

FIG. 13 shows an example of the profile group after the tray-by-tray registration button B44 is selected.

Assuming that FIG. 3 shows an example of the profile group before the tray-by-tray registration button B44 is selected, the profile group will be changed as shown in FIG. 13 under the following conditions: the selected tray is tray 1; a type of paper sheets stacked in the selected tray corresponds to profile number "01"; a change instruction value "4" is specified with respect to a floating unit and a change instruction value "7" is specified with respect to an adhering unit on the setting value instruction area E4 of the air assist condition setting screen G4. That is, as shown in FIG. 13, the setting values of the floating unit and adhering unit of the tray 1 of profile number "01" are changed into the change instruction values "4" and "7", respectively.

Accordingly, in the setting value table, the setting values of the paper feed unit of the paper feed tray 1 referring to this profile number "01" will be changed.

FIG. 14 shows an example of the setting value table for each paper feed unit of each paper feed tray after the tray-by-tray registration button B44 is selected.

Since the setting values of the floating unit and adhering unit of the tray 1 of the profile number "01" are changed into the change instruction values "4" and "7", respectively in the profile group, the setting values of the floating unit and adhering unit of the tray 1 of reference profile number "01" are changed into "4" and "7", respectively as shown in FIG. 14. It should be noted that the setting values of the floating unit and adhering unit of the tray 3 of reference profile number "01" are unchanged. Accordingly, the setting values of the floating unit and adhering unit of the tray 3 are kept at setting values "3" and "5", respectively which are set before the tray-by-tray registration button B44 is selected.

If the tray-by-tray registration button B44 is not selected on the air assist condition setting screen G4 (step S13; No) or after step S14, the control unit 110 determines whether the check button B45 is selected (step S15).

If the check button B45 is selected (step S15; Yes), the control unit 110 returns to step S1. If the check button B45 is not selected (step S15; No), the control unit 110 determines whether the close button B47 is selected (step S16).

If the close button B47 is not selected (step S16; No), the control unit 110 returns to step S11. If the close button B47 is selected (step S16; Yes), the control unit 110 returns to step S6.

If the machine tab G16 is not selected on the basic screen G1 (step S2; No), the control unit 110 determines whether printing is specified by the printing unit 40 (step S17).

If the printing is not specified (step S17; No), the control unit 110 proceeds to processing based on another button operation, and then terminates the air assist condition setting processing. In step S17, the control unit 110 determines that the printing is not specified if another button is selected except when the basic screen G1 appears after the check button B45 is selected on the air assist condition setting screen G4 or when the start button 32 or the check button 33 is selected during the air assist condition setting screen G4 is displayed.

If the printing is specified (step S17; Yes), the control unit 110 executes paper feed processing (step S18), image forming processing for forming an image on the fed paper sheet (step S19) and output processing for outputting the paper sheet on which the image has been formed to a specified output tray (step S20) in accordance with job information. In the paper feed processing, a paper sheet is carried from a specified paper feed tray by a corresponding paper feed unit at an air flow quantity based on the setting values of the specified paper feed tray in a profile corresponding to a type of paper sheets stacked in the specified paper feed tray. In step S17, the control unit 110 determines that the printing is specified when the basic screen G1 appears after the check button B45 is selected on the air assist condition setting screen G4 or when the start button 32 or the check button 33 is selected during the air assist condition setting screen G4 is displayed.

After step S20, the control unit 110 determines whether the proof mode is set or not (step S21). The proof mode is set when the basic screen G1 appears after the check button B45 is selected on the air assist condition setting screen G4 or when the check button 33 is selected during the air assist condition setting screen G4 is displayed, in step S17.

In the proof mode (step S21; Yes), the control unit 110 determines whether the paper sheet outputted in the output processing is a paper sheet for separating each copy or not (step S22). If the paper sheet outputted in the output processing is not a paper sheet for separating each copy (step S22; No), the control unit 110 returns to step S18. In case of the paper sheet for separating each copy (step S22; Yes), the control unit 110 stops the printing operation, that is, stops the operation of the printing unit 40 (step S23), releases a setting of the proof mode (step S24), and causes the operation display unit 30 to display a check screen on the LCD (step S25).

Figure 15:
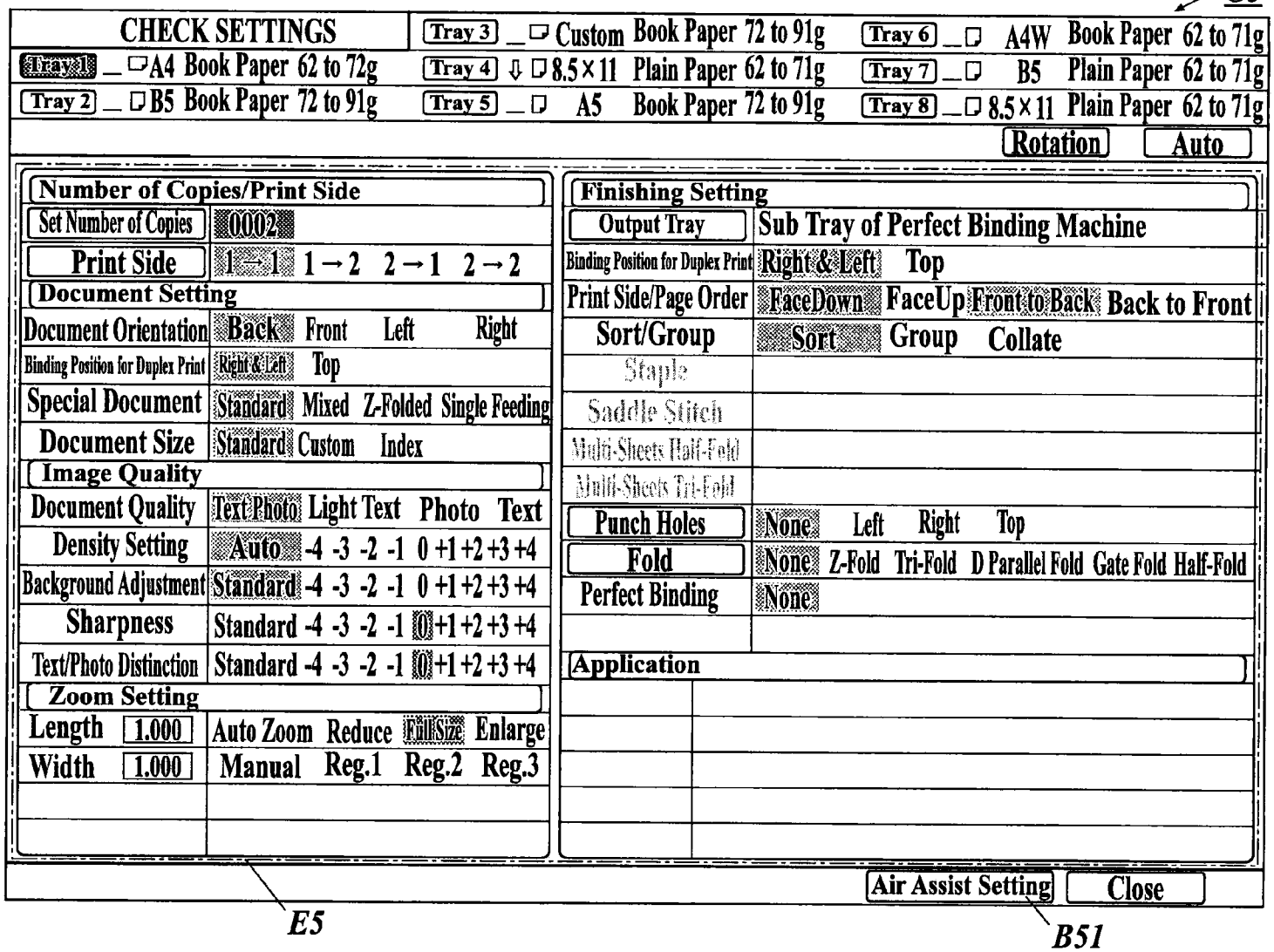
FIG. 15 shows an example of a check screen.

FIG. 15 shows an example of the check screen G5.

As shown in FIG. 15, the check screen G5 has a job display area E5 and an air assist setting button B51 for changing air flow quantity. On the job display area E5, various settings such as the number of copies/print side of a job executed in the proof mode, a document (original) setting, an image quality setting, a zoom setting and a finishing setting are displayed.

The control unit 110 determines whether the air assist setting button B51 is selected on the check screen G5 (step S26). If the air assist setting button B51 is selected (step S26; Yes), the control unit 110 returns to step S10.

If the air assist setting button B51 is not selected on the check screen G5 (step S26; No), the control unit 110 determines whether the start button 32 or the check button 33 is selected or not (step S27).

If the start button 32 or the check button 33 is not selected (step S27; No), the control unit 110 returns to step S25. If the start button 32 or the check button 33 is selected (step S27; Yes), the control unit 110 returns to step S18.

After step S20, if the proof mode is not set (for example, if the start button is selected in step S17) (step S21; No), the control unit 110 refers to the job information and determines whether the printing of set number of copies has ended or not (step S28).

If the printing of set number of copies has not ended (step S28; No), the control unit 110 returns to step S18. If the printing of set number of copies has ended (step S28; Yes), the air assist condition setting processing terminates.

As described above, according to the embodiments, one or more of the setting values of paper feed units which are defined according to types of paper sheet and stored in the non-volatile memory 120 can be changed into change instruction values specified through the air assist condition setting screen, and the changed setting values are stored in the non-volatile memory 120. Accordingly, if the same type of paper sheets are stacked in a plurality of paper feed trays, a user does not have to change the setting values of the paper feed units of the paper feed trays individually. Therefore, it is possible to reduce a work load when changing setting values of each paper feed unit and thus enhance operationality of the image forming apparatus 1.

Specifically, if the air assist condition registration button B43 is selected, the setting values corresponding to a type of paper sheets stacked in the selected tray can be changed into the change instruction values specified through the air assist condition setting screen and the changed setting values can be stored. Accordingly, the setting values of the paper feed unit of the paper feed tray in which the same type of paper sheets as the selected tray are stacked can be changed by simply changing the setting values of the paper feed unit of the selected tray. Therefore, it is possible to reduce a work load when changing setting values of each paper feed unit.

Moreover, if the tray-by-tray registration button B44 is selected, only the setting values corresponding to a type of paper sheets stacked in the selected tray and corresponding to the paper feed unit provided to the selected tray can be changed. Therefore, it is possible to change setting values for each paper feed unit when the setting values are different for different paper feed units even if the same type of paper sheets are stacked in the different paper feed units because of difference in mechanical condition such as clogging of a filter of a fan for sucking or discharging air into or from each paper feed unit. Thus, the operationality of the image forming apparatus can be enhanced.

Furthermore, after the checking processing (proof mode) of the image forming apparatus which is a processing of feeding at least one paper sheet into a paper path by one of the paper feed units based on the setting values of the one of the paper feed units stored in the non-volatile memory 120, change instruction values of the setting values can be specified. Therefore, the setting values can be changed while checking the operations of the paper feed units, and thus the operationality of the image forming apparatus can be enhanced.

In the above description, the non-volatile memory such as a read only memory (ROM) or a flash memory has been presented as a computer-readable medium embodying a program according to the embodiments of the present invention. A removable medium such as a CD-ROM may be employed as another computer-readable medium. Moreover, a carrier wave may be used as a medium that provides program data related to the embodiments disclosed herein via communication lines.

The present invention is not to be considered limited to what is shown in the above-described embodiments. It will be obvious to those skilled in the art that various changes may be made without departing from the scope of the invention.

According to one aspect of the preferred embodiments of the present invention, there is provided an image forming apparatus including: a plurality of paper feed trays in which paper sheets are to be stacked and stocked; paper feed units each provided to each of the plurality of paper feed trays, the paper feed units sucking or discharging air in accordance with setting values corresponding to types of paper sheet to carry the paper sheets stacked in the respective paper feed trays toward a paper path; a storage unit to store the setting values for the paper feed units according to the types of paper sheet; an input unit to input a change instruction value for changing at least one of the setting values; and a control unit to change the at least one of the setting values stored in the storage unit into the change instruction value inputted through the input unit and to store the changed at least one of the setting values into the storage unit.

In the image forming apparatus, at least one of the setting values for paper feed units which are defined according to types of paper sheet and stored in the storage unit can be changed into the change instruction value inputted through the input unit, and the changed at least one of the setting values are stored in the storage unit. Accordingly, if the same type of paper sheets are stacked in a plurality of paper feed trays, a user does not have to change the setting values of the paper feed units of the paper feed trays individually. Therefore, it is possible to reduce a work load when changing setting values of each paper feed unit and thus enhance operationality of the image forming apparatus.

Preferably, the image forming apparatus further including a tray selection unit to input an instruction to select at least one of the paper feed trays, wherein the input unit includes: a setting value instruction section to input the change instruction value for changing the at least one of the setting values which corresponds to a type of paper sheets stacked in the at least one of the paper feed trays selected through the tray selection unit; and a first registration section to input an instruction to change the at least one of the setting values which corresponds to a type of paper sheets stacked in the at least one of the paper feed trays selected through the tray selection unit, into the change instruction value inputted through the setting value instruction section, and when the instruction is inputted through the first registration section, the control unit changes the at least one of the setting values which corresponds to a type of paper sheets stacked in the at least one of the paper feed trays selected through the tray selection unit, into the change instruction value inputted through the setting value instruction section, and stores the changed at least one of the setting values into the storage unit.

At least one of the setting values corresponding to a type of paper sheets stacked in the selected paper feed tray can be changed into the change instruction value inputted through the input unit and the changed at least one of the setting values can be stored. Accordingly, at least one of the setting values of the paper feed unit of the paper feed tray in which the same type of paper sheets as the selected paper feed tray are stacked can be changed by simply changing at least one of the setting values of the paper feed unit provided to the selected paper feed tray. Therefore, it is possible to reduce a work load when changing setting values of each paper feed unit.

Preferably, the setting values are defined for each type of paper sheet and each paper feed unit, the input unit includes a second registration section to input an instruction to change the at least one of the setting values which corresponds to a type of paper sheets stacked in the at least one of the paper feed trays selected through the tray selection unit and which corresponds to at least one of the paper feed units which is provided to the selected at least one of the paper feed trays, into the change instruction value inputted through the setting value instruction section, and when the instruction is inputted through the second registration section, the control unit changes the at least one of the setting values which corresponds to a type of paper sheets stacked in the at least one of the paper feed trays selected through the tray selection unit and which corresponds to at least one of the paper feed units which is provided to the selected at least one of the paper feed trays, into the change instruction value inputted through the setting value instruction section, and stores the changed at least one of the setting values into the storage unit.

At least one of the setting values which corresponds to a type of paper sheets stacked in the selected paper feed tray and which corresponds to the paper feed unit provided to the selected paper feed tray can only be changed. Therefore, it is possible to change the setting values for each paper feed unit when the setting values are different for different paper feed units even if the same type of paper sheets are stacked in the different paper feed units because of difference in mechanical condition such as clogging of a filter of a fan for sucking or discharging air into or from each paper feed unit. Thus, the operationality of the image forming apparatus can be enhanced.

Preferably, the image forming apparatus further including a check instruction unit to input an instruction to execute checking processing of operations in the image forming apparatus, wherein the checking processing contains a processing of feeding at least one paper sheet into the paper path by one of the paper feed units based on at least one of the setting values stored in the storage unit, and when the instruction to execute the checking processing is inputted through the check instruction unit, the control unit accepts an input of the change instruction value for changing at least one of the setting values from the input unit after executing the checking processing.

After the checking processing of the image forming apparatus, the input of the change instruction value can be accepted. Therefore, the setting values can be changed while checking the operations of the paper feed units, and thus the operationality of the image forming apparatus can be enhanced.

Preferably, the types of paper sheet are classified according to paper types and paper weight of paper sheet, and the setting values stored in the storage unit are predefined according to the paper types and paper weight of paper sheet.

Thus, the setting values can be predefined according to the paper types and paper weight of paper sheet The present U.S. patent application claims a priority under the Paris Convention of Japanese patent application No. 2007-315919 filed on Dec. 6, 2007 which shall be a basis of correction of an incorrect translation.

What is claimed is:

1. An image forming apparatus comprising:

a plurality of paper feed trays in which paper sheets are to be stacked and stocked;

paper feed units each provided to each of the plurality of paper feed trays, the paper feed units sucking or discharging air in accordance with setting values corresponding to types of paper sheet to carry the paper sheets stacked in the respective paper feed trays toward a paper path;

a storage unit to store the setting values for the paper feed units according to the types of paper sheet;

an input unit to input a change instruction value for changing at least one of the setting values; and a control unit to change the at least one of the setting values stored in the storage unit into the change instruction value inputted through the input unit and to store the changed at least one of the setting values into the storage unit.

2. The image forming apparatus of claim 1, further comprising a tray selection unit to input an instruction to select at least one of the paper feed trays, wherein the input unit includes:

a setting value instruction section to input the change instruction value for changing the at least one of the setting values which corresponds to a type of paper sheets stacked in the at least one of the paper feed trays selected through the tray selection unit; and a first registration section to input an instruction to change the at least one of the setting values which corresponds to a type of paper sheets stacked in the at least one of the paper feed trays selected through the tray selection unit, into the change instruction value inputted through the setting value instruction section, and when the instruction is inputted through the first registration section, the control unit changes the at least one of the setting values which corresponds to a type of paper sheets stacked in the at least one of the paper feed trays selected through the tray selection unit, into the change instruction value inputted through the setting value instruction section, and stores the changed at least one of the setting values into the storage unit.

3. The image forming apparatus of claim 2, wherein the setting values are defined for each type of paper sheet and each paper feed unit, the input unit includes a second registration section to input an instruction to change the at least one of the setting values which corresponds to a type of paper sheets stacked in the at least one of the paper feed trays selected through the tray selection unit and which corresponds to at least one of the paper feed units which is provided to the selected at least one of the paper feed trays, into the change instruction value inputted through the setting value instruction section, and when the instruction is inputted through the second registration section, the control unit changes the at least one of the setting values which corresponds to a type of paper sheets stacked in the at least one of the paper feed trays selected through the tray selection unit and which corresponds to at least one of the paper feed units which is provided to the selected at least one of the paper feed trays, into the change instruction value inputted through the setting value instruction section, and stores the changed at least one of the setting values into the storage unit.

4. The image forming apparatus of claim 1, further comprising a check instruction unit to input an instruction to execute checking processing of operations in the image forming apparatus, wherein the checking processing contains a processing of feeding at least one paper sheet into the paper path by one of the paper feed units based on at least one of the setting values stored in the storage unit, and when the instruction to execute the checking processing is inputted through the check instruction unit, the control unit accepts an input of the change instruction value for changing at least one of the setting values from the input unit after executing the checking processing.

5. The image forming apparatus of claim 1, wherein the types of paper sheet are classified according to paper types and paper weight of paper sheet, and the setting values stored in the storage unit are predefined according to the paper types and paper weight of paper sheet.

* * * * *